US006583686B2

(12) United States Patent
Matsumura et al.

(10) Patent No.: US 6,583,686 B2
(45) Date of Patent: Jun. 24, 2003

(54) LC-INCLUDED ELECTRONIC COMPONENT

(75) Inventors: Sadayuki Matsumura, Takefu (JP); Noboru Kato, Sabae (JP); Hiroko Nomura, Fukui-ken (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 09/836,592

(22) Filed: Apr. 17, 2001

(65) Prior Publication Data

US 2001/0035803 A1 Nov. 1, 2001

(30) Foreign Application Priority Data

Apr. 28, 2000 (JP) ..... 2000-131447

(51) Int. Cl.[7] ..... H03H 7/06
(52) U.S. Cl. ..... 333/175; 333/185
(58) Field of Search ..... 333/175, 185, 333/204, 177; 336/200

(56) References Cited

U.S. PATENT DOCUMENTS 5,834,992 A * 11/1998 Kato et al. ..... 333/185
5,945,892 A * 8/1999 Kato et al. ..... 333/185
6,124,779 A * 9/2000 Yamamoto ..... 29/604

FOREIGN PATENT DOCUMENTS

| | | | |
|---|---|---|---|
| EP | 1 079 520 A2 | | 2/2001 |
| JP | 08288142 A1 | * | 11/1996 |
| JP | 9-035936 A | | 2/1997 |
| JP | 9-205018 A | | 8/1997 |
| JP | 09219315 A1 | * | 8/1997 |
| JP | 2000165171 A1 | * | 6/2000 |

* cited by examiner

*Primary Examiner*—Seungsook Ham
(74) *Attorney, Agent, or Firm*—Keating & Bennett, LLP

(57) ABSTRACT

An LC-included electronic component has a greatly reduced size, a greatly increased resonator Q, and outstanding reliability. Inductor via holes are successively connected in a direction in which insulating sheets are stacked to define columnar inductors. The inductor via holes each have a Y-direction dimension greater than an X-direction dimension on the X-Y plane of a section shape, and the shape has Y-direction ends of increased width. Specifically, each Y-direction end of the inductor via holes is substantially circular, and the other portions are linear.

18 Claims, 8 Drawing Sheets

LC-INCLUDED ELECTRONIC COMPONENT

BACKGROUND OF THE INVENTION

1. Field of the Invention

The present invention relates to LC-included electronic components, and in particular, to an LC-included electronic component for use in a high frequency band.

2. Description of the Related Art

A conventional laminated LC filter is shown in FIGS. 10 and 11. As shown in FIG. 10, a laminated LC filter 1 includes ceramic sheets 2 to 8 each having a plurality of inductor via holes 10*a* to 10*d*, 11*a* to 11*d*, and 12*a* to 12*d*, resonant capacitor patterns 13 to 15, coupling capacitor patterns 19 to 26, input/output lead patterns 30 and 31, and shield patterns 28 and 29.

The laminated unit 34 shown in FIG. 11 is obtained by stacking the ceramic sheets 2 to 8 in the Z direction, covering the top and bottom surfaces of the sheets with protecting ceramic sheets, and monolithically burning the ceramic sheets. An input terminal P1, an output terminal P2, and ground terminals G1 and G2 are provided on the laminated unit 34. The input/output lead pattern 30 is connected to the input terminal P1, and the input/output lead pattern 31 is connected to the output terminal P2. Ends of the shield patterns 28 and 29 are connected to the ground terminal G1 and the other ends of the shield patterns 28 and 29 are connected to the ground terminal G2.

In the above-described LC filter 1, the inductor via holes 10*a* to 10*d*, 11*a* to 10*d*, and 12*a* to 12*d*, which are arranged in the X direction in FIG. 10, are successively connected to one another in a direction in which the ceramic sheets are stacked, defining columnar inductors L1, L2, and L3. The resonant capacitor patterns 13, 14, and 15 are opposed to the shield pattern 29, with the ceramic sheets 6 and 7 provided therebetween, defining resonant capacitors C1, C2, and C3, respectively. Accordingly, the columnar inductor L1 and the capacitor C1 define an LC resonator Q1, the columnar inductor L2 and the capacitor C2 define an LC resonator Q2, and the columnar inductor L3 and the capacitor C3 define an LC resonator Q3.

In general, filter characteristics of an LC filter are subject to resonator Q. The Q of the resonator is primarily determined by the Q of an inductor. The Q of the inductor is subject to a loss (resistance) of the inductor. Accordingly, to increase Q of the LC resonators Q1 to Q3 which define the LC filter 1, the section areas on the X-Y plane of the columnar inductors L1 to L3 formed by successively connecting the via holes must be increased. However, since the conventional columnar inductors L1 to L3 have circular section shapes, the increased section areas narrow the intervals of the columnar inductors L1 to L3, which are adjacent, and generate excessively strong inductive coupling. Therefore, to obtain the desired inductive coupling, the intervals of the columnar inductors L1 to L3 must be substantially widened, which results in a substantially increased product size.

In When the via holes 10*a* to 12*d* having section areas are provided on the ceramic sheets 2 to 5 to increase Q, cracks often occur in the laminated unit 34 when it is burned, due to the difference in thermal contraction between conductive material of the via holes 10*a* to 12*d* and insulating material of the ceramic sheets 2 to 5. Thus, the section areas of the via holes 10*a* to 12*d* cannot be sufficiently increased.

SUMMARY OF THE INVENTION

To overcome the above-described problems with the prior art, preferred embodiments of the present invention provide a small-sized LC-included electronic component having an increased Q of a resonator and having outstanding reliability.

An LC-included component according to a preferred embodiment of the present invention includes an LC resonator having at least one inductor and at least one capacitor. The at least one inductor and the at least one capacitor are provided in a laminated unit defined by stacked insulating layers. The inductor is defined by via holes successively connected in a stack direction in which the insulating layers are stacked. In the section shape of each of the via holes on an X-Y plane perpendicular to the stack direction, a dimension in the X direction differs from a dimension in the Y direction.

By differentiating the X dimension and Y dimension of each via hole, a desired balanced inductive coupling and resonator Q are achieved, even when the section area of each via hole is increased.

In addition, by arranging the Y-direction ends of the section shape of each via hole defining the inductor to have a relatively large width, current concentration at each longitudinal end of each via hole due to the edge effect of high frequency current is reduced.

Other features, characteristics, elements and advantages of the present invention will become more apparent from the detailed description of preferred embodiments thereof with reference to the attached drawings.

DETAILED DESCRIPTION OF PREFERRED EMBODIMENTS

Preferred embodiments of according to the present invention are described below with reference to the accompanying drawings.

Figure 1:
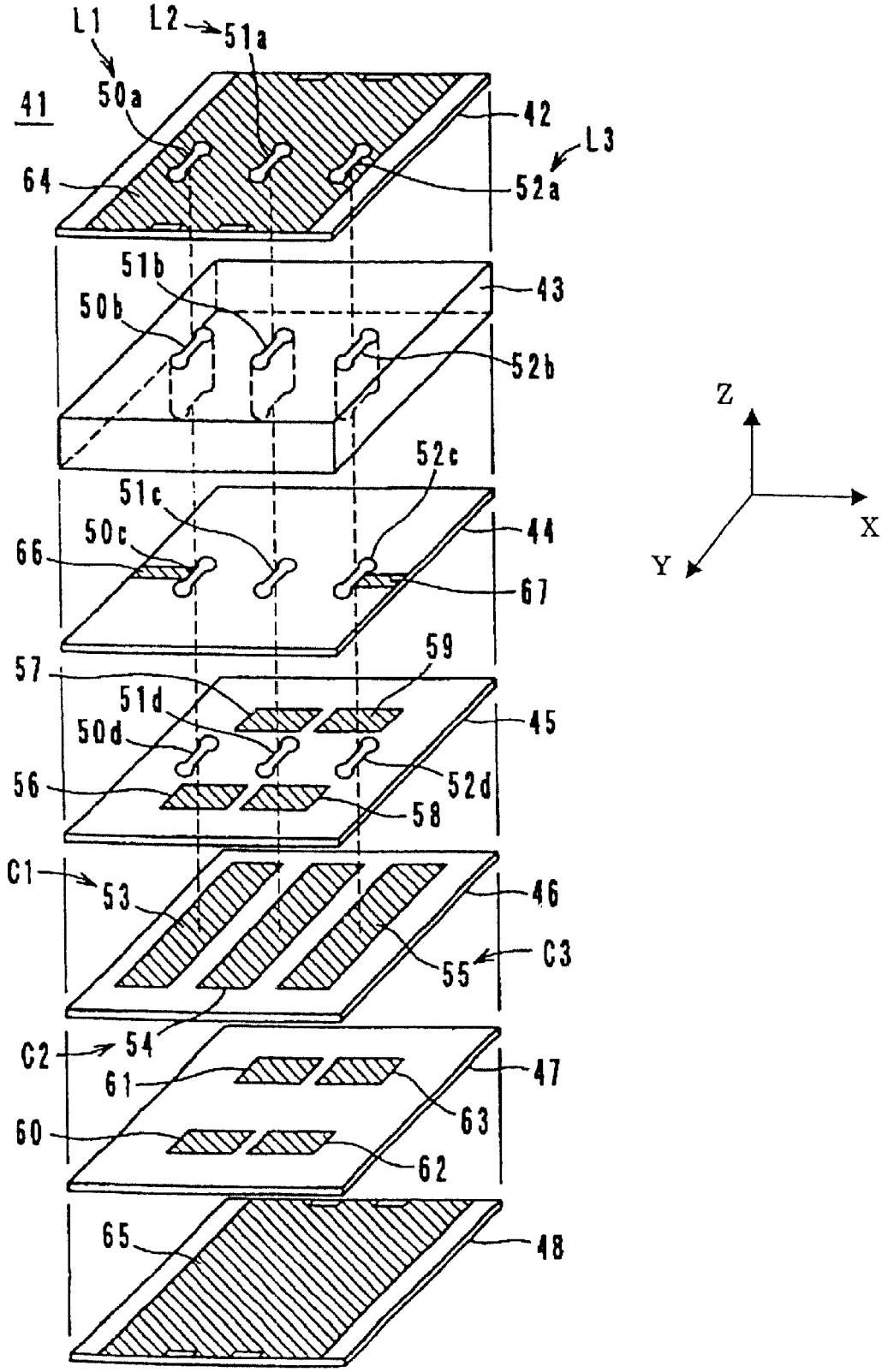
FIG. 1 is an exploded perspective view showing an LC-included electronic component according to a first preferred embodiment of the present invention.
Figure 3:
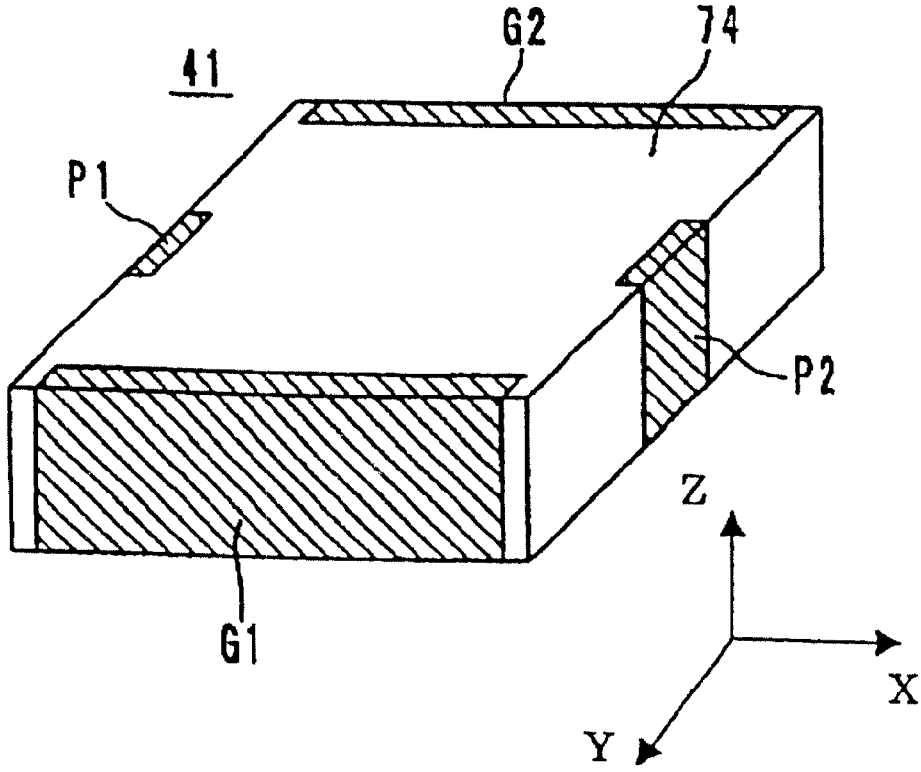
FIG. 3 is a perspective exterior view of the LC-included electronic component shown in FIG. 1.
Figure 4:
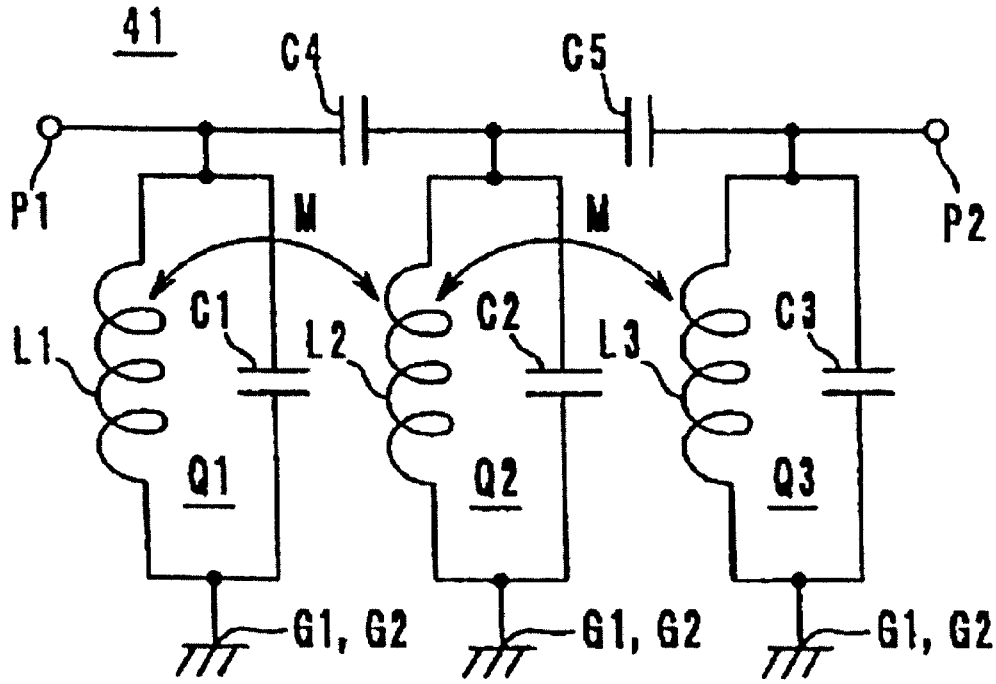
FIG. 4 is an equivalent electric circuit diagram of the LC-included electronic component shown in FIG. 1.

FIG. 1 shows the structure of an LC-included electronic component 41 according to a first preferred embodiment of the present invention, and FIGS. 3 and 4 show a perspective exterior view and electric equivalent circuit diagram of the LC-included electronic component 41, respectively. The LC-included electronic component 41 is a three-stage band-pass filter including LC resonators Q1, Q2, and Q3.

As shown in FIG. 1, the LC filter 41 includes insulating sheets 42 to 48 that each have inductor via holes 50*a* to 50*d*, 51*a* to 51*d*, and 52*a* to 52*d*, resonant capacitor patterns 53 to 55, coupling capacitor patterns 56 to 63, input/output lead patterns 66 and 67, and shield patterns 64 and 65. The insulating sheets 42 to 48 are each obtained by mixing dielectric powder, magnetic powder, a binder agent, and forming the mixture into a sheet. The patterns 53 to 67 are each preferably composed of Ag, Pd, Cu, Ni, Au, Ag—Pd, or other suitable material, and are formed by a method such as printing or other suitable method. The inductor via holes 50*a* to 52*d* are each formed by providing, in each of the insulating sheets 42 to 45, a hole that has the desired shape by using a mold or a laser, and covering the hole with conductive material such as Ag, Pd, Cu, or Ag—Cu.

The inductor via holes 50*a* to 50*d*, 51*a* to 51*d*, and 52*a* to 52*d*, which are arranged in the X direction of the X-Y plane, are successively connected in a direction (the Z direction) in which the insulating sheets 42 to 45 are stacked to define columnar inductors L1, L2, and L3. The axial direction of the inductors L1 to L3 are preferably substantially perpendicular to the X-Y planes of the sheets 42 to 45. Ends (the via holes 50*d*, 51*d*, and 52*d*) of the inductors L1 to L3 are connected to the resonant capacitor patterns 53 to 55. The other ends (the via holes 50*a*, 51*a*, and 52*a*) of the inductors L1 to L3 are connected to the shield pattern 64 for short-circuiting.

Figure 2:
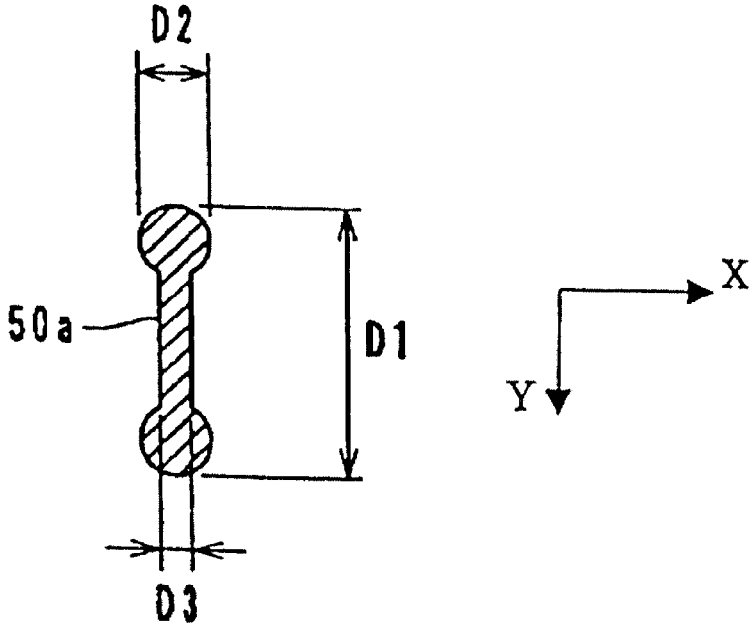
FIG. 2 is a cross-sectional view of an inductor via hole of the LC-included electronic component shown in FIG. 1.

As shown in FIG. 2, each section shape of the inductor via holes 50*a* to 52*d* has, on the X-Y plane perpendicular to the Z direction, a Y-direction dimension D1 longer than a X-direction dimension D2, and both Y-direction ends are wider than the width of the central portion. Specifically, the longitudinal end of each of the inductor via holes 50*a* to 52*d* has a substantially circular shape having a diameter of D2, and the other portion is linear having a width of D3 (<D2). By way of example, each of the inductor via holes 50*a* to 52*d* preferably has approximate dimensions of, for example, D1=1.2 mm, D2=0.2 mm, and D3=0.1 mm. It is preferable that the diameter D2 is about one to about four times the width D3.

When currents flow in the inductors L1 to L3, magnetic fields extending on the plane vertical to the axial direction of the inductors L1, L2, and L3 are generated around the inductors L1, L2, and L3. The inductor via holes 50*c* and 52*c* are connected to the input lead pattern 66 and the output lead pattern 67, respectively. The input lead pattern 66 is exposed at one X-direction end of the sheet 44, and the output lead pattern 67 is exposed at the other X-direction end of the sheet 44.

The resonant capacitor patterns 53, 54, and 55 are opposed to the shield pattern 65, with the insulating sheets 46 and 47 provided therebetween to define resonant capacitors C1, C2, and C3. The resonant capacitor pattern 53 is directly connected to an end (the via hole 50*d*) of the inductor L1, and the inductor L1 and the capacitor C1 define the LC resonator Q1. The resonant capacitor pattern 54 is directly connected to an end (the via hole 51*d*) of the inductor L2, and the inductor L2 and the capacitor C2 define the LC resonator Q2. The resonant capacitor pattern 55 is directly connected to an end (the via hole 52*d*) of the inductor L3, and the inductor L3 and the capacitor C3 define the LC resonator Q3.

The capacitor patterns 53 and 54 are opposed to coupling capacitor patterns 56, 57, 60, and 61, with the capacitor patterns 53 and 54 provided between the sheets 45 and 46 to define a coupling capacitor C4 for coupling the LC resonators Q1 and Q2. The capacitor patterns 54 and 55 are opposed to the coupling capacitor patterns 58, 59, 62, and 63, with capacitor patterns 54 and 55 provided between the sheets 45 and 46 to define a coupling capacitor C5 for coupling the LC resonators Q2 and Q3 is formed. Between the inductor via holes 50*a* to 50*d* and 51*a* to 51*d*, and between the inductor via holes 51*a* to 51*d* and 52*a* to 52*d*, mutual inductances M are produced, which establish magnetic coupling between the resonators Q1 and Q2 and between the resonators Q2 and Q3.

The sheets 42 to 48 are sequentially stacked as shown in FIG. 1, and their top and bottom are covered with protecting insulating sheets. The sheets are monolithically burned. This provides the laminated unit 74 (having approximate dimensions of e.g., L=5 mm, W=4 mm, and H=2 mm) shown in FIG. 3. On the right and left sides of the laminated unit 74, an input terminal P1 and an output terminal P2 are provided, respectively, and on the front and back sides, ground terminals G1 and G2 are provided, respectively. The input lead pattern 66 is connected to the input terminal P1, the output lead pattern 67 is connected to the output terminal P2, and the shield patterns 64 and 65 are connected to the ground terminals G1 and G2.

In the obtained laminated LC filter 41, by lengthening the Y-direction dimension D1 on the X-Y plane of each section shape of the inductor via holes 50*a* to 50*d*, 51*a* to 51*d*, and 52*a* to 52*d* than the X-direction dimension D2, each section area of the inductor via holes 50*a* to 52*d* is increased without widening the intervals of the adjacent inductors L1 to L3. In other words, to increase each section area of the inductor via holes 50*a* to 52*d*, the Y-direction dimension D1 is increased and the X-direction dimension D2 is unchanged. This enables a greatly improved Q of the resonators Q1 to Q3.

Even if each Y-direction dimension D1 on the X-Y plane of the inductor via holes 50*a* to 52*d* is increased to improve Q, the difference in thermal contraction between conductive material for the inductor via holes 50*a* to 52*d* and insulating material for the sheets 42 to 48 is greatly relaxed because the X-direction dimension D2 is less than the Y-direction dimension D1. Thus, cracks are prevented from occurring in the laminated unit 74.

When the frequency is higher, the currents that flow in the inductors L1 to L3 are concentrated on the Y-direction periphery of each section of the inductors L1 to L3 by the edge effect. Accordingly, to reduce losses in the inductors L1 to L3, a current concentrating portion is deconcentrated and the section area of the portion is increased. In the first preferred embodiment, each section shape of the inductor via holes 50*a* to 52*d* has wide Y-direction ends, whereby current concentration at each end of the inductor via holes 50*a* to 52*d* due to the high-frequency-current edge effects are relaxed and deconcentrated. Therefore, losses (resistances) of the inductors L1 to L3 are greatly reduced, and Q of the inductors L1 to L3 is greatly increased.

Each section of the inductor via holes 50*a* to 52*d* preferably has an arbitrary shape, and in addition to the shape shown in FIG. 2, as shown in portions (A) and (B) of FIG. 5, shapes (A) a case in which the major axis of an ellipse is preferably substantially perpendicular to the Y direction of the section of a via hole and (B) a case in which the minor axis of an ellipse is substantially perpendicular to the Y direction of the section of a via hole) that each have elliptic ends may be used. Otherwise, shapes that have bifoliate ends and trifoliate ends as shown in portions (C) and (D) of FIG.

Figure 5A:
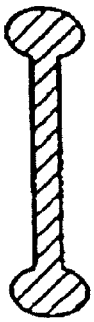
FIG. 5 is an illustration of modifications of an inductor via hole.
Figure 5B:
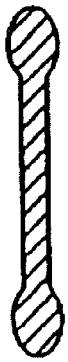
Figure 5C:
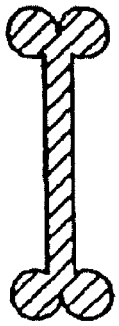
Figure 5D:
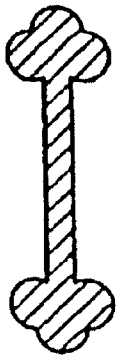
Figure 5E:
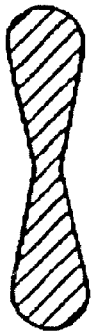
Figure 5F:
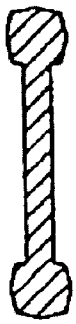
Figure 5G:
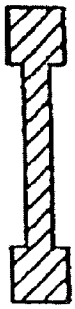
Figure 5H:
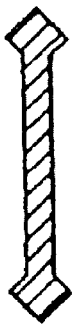
Figure 5I:
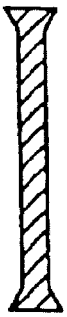
Figure 5J:
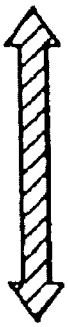
Figure 5J:
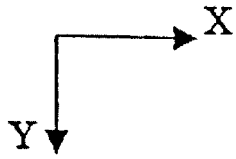

5, and a shape that has a longitudinal constriction as shown in FIG. 5(E) may be used. In addition, as shown in portions (F), (G), (H), (I), and (J) of FIG. 5, shapes may be used that have octagonal ends, square ends, parallelogramic ends, inverse triangular ends, and equilaterally triangular ends.

Figure 6:
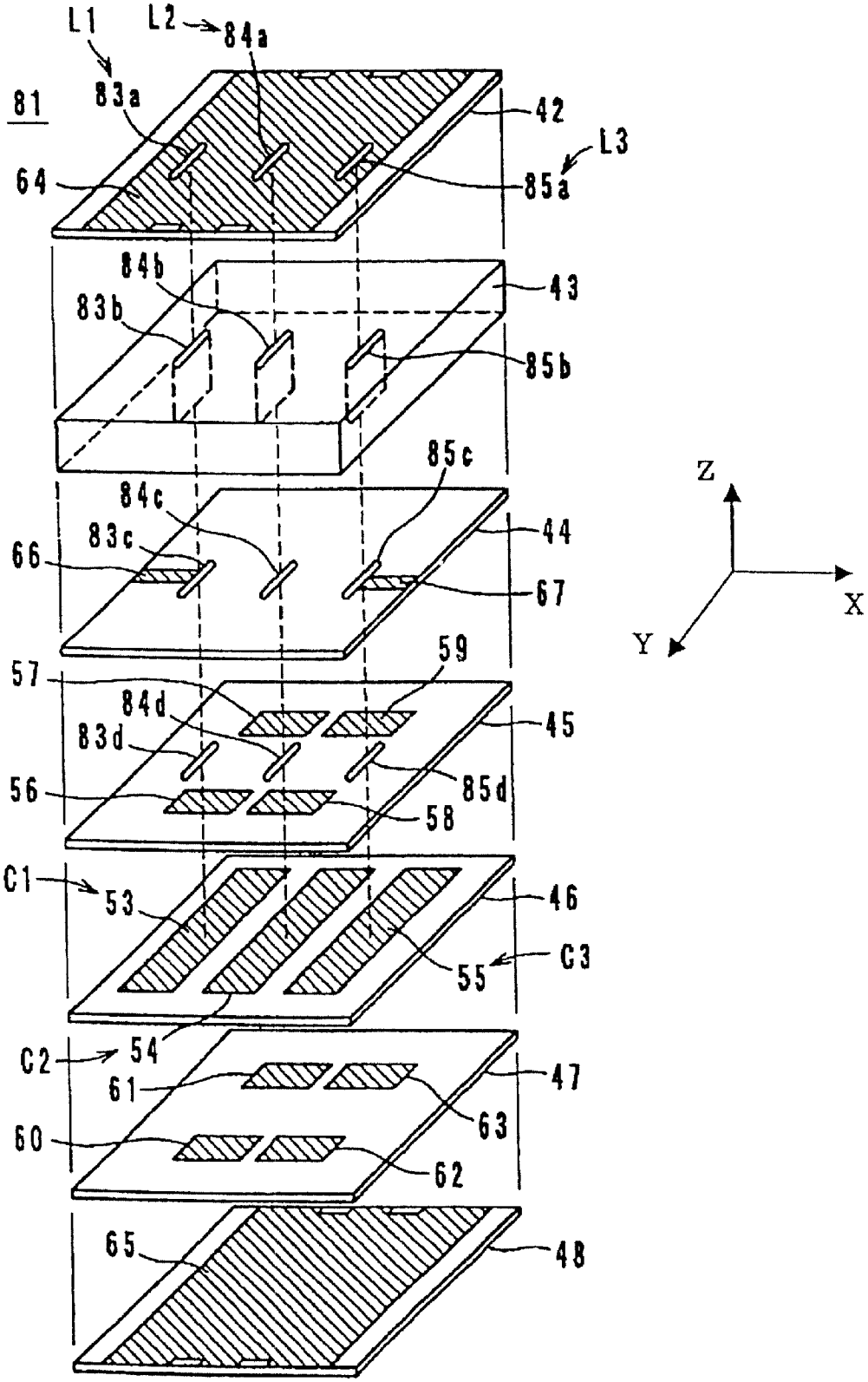
FIG. 6 is an exploded perspective view showing an LC-included electronic component according to a second preferred embodiment of the present invention.
Figure 7:
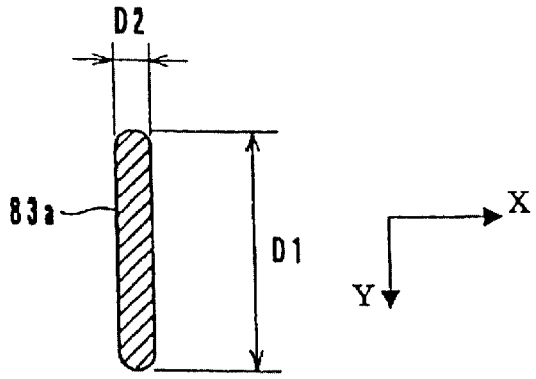
FIG. 7 is a cross-sectional view of an inductor via hole of the LC-included electronic component shown in FIG. 6.
Figure 8:
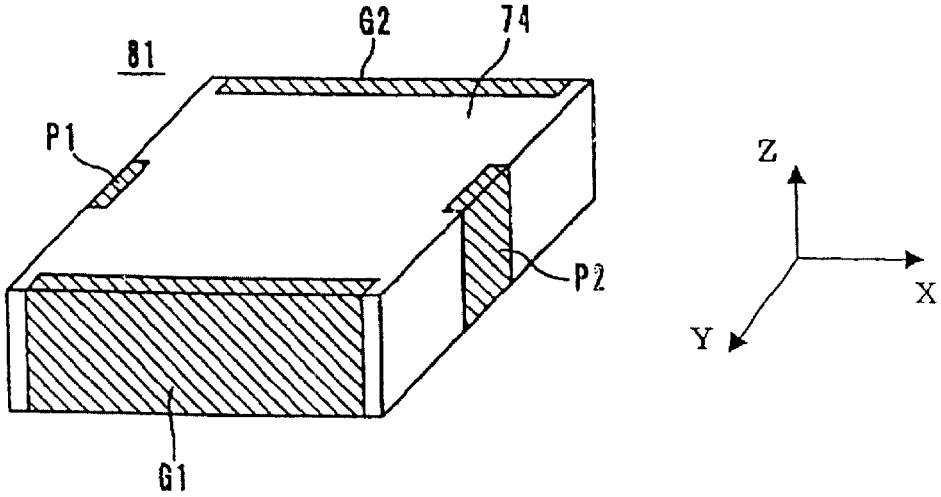
FIG. 8 is a perspective exterior view of the LC-included electronic component shown in FIG. 6.

As shown in FIGS. 6 to 8, a laminated LC filter 81 according to a second preferred embodiment of the present invention is identical to the LC filter 41 according to the first preferred embodiment, except for inductor via holes 83*a* to 83*d*, 84*a* to 84*d*, and 85*a* to 85*d*. The inductor via holes 83*a* to 83*d* have an advantage in that they are easy to produce because each section shape on the X-Y plane of them is linear and simplified. By using identical reference numerals to denote components identical to those in FIGS. 1 to 3, repetition is omitted in the following description.

The inductor via holes 83*a* to 83*d*, 84*a* to 84*d*, and 85*a* to 85*d*, which are arranged in the X-direction of the X-Y plane, are successively connected in a direction (the Z direction) in which insulating sheets 42 to 45 are stacked to define columnar inductors L1, L2, and L3. The axial direction of the inductors L1 to L3 is substantially perpendicular to surfaces of the sheets 42 to 45.

As shown in FIG. 7, each section of the inductor via holes 83*a* to 85*d* has a Y-direction dimension D1 longer than a X-direction dimension D2 on the X-Y plane. This increases each section area of the inductor via holes 83*a* to 85*d* without widening the intervals of the adjacent inductors L1 to L3. In other words, when each section area of the inductor via holes 83*a* to 85*d* is increased, the Y-direction dimension D1 is increased and the X-direction dimension D2 is unchanged. This enables a greatly improved Q of the resonators Q1 to Q3. By way of example, the inductor via holes 83*a* to 85*d* are configured to have approximate dimensions of, for example, D1=1.2 mm and D2=0.2 mm.

When the frequency is higher, the currents that flow in the inductors L1 to L3 are concentrated on the Y-direction periphery of each section of the inductors L1 to L3 by the edge effect. Accordingly, to reduce losses in the inductors L1 to L3, a current concentrating portion is deconcentrated. In the second preferred embodiment, by forming both Y-direction ends of each section shape of the inductor via holes 83*a* to 85*d* to be substantially semicircular, current concentration at each end of the inductor via holes 83*a* to 85*d* due to the high-frequency-current edge effects is greatly relaxed and deconcentrated.

Figures 9A, 9B, 9C, 9D:
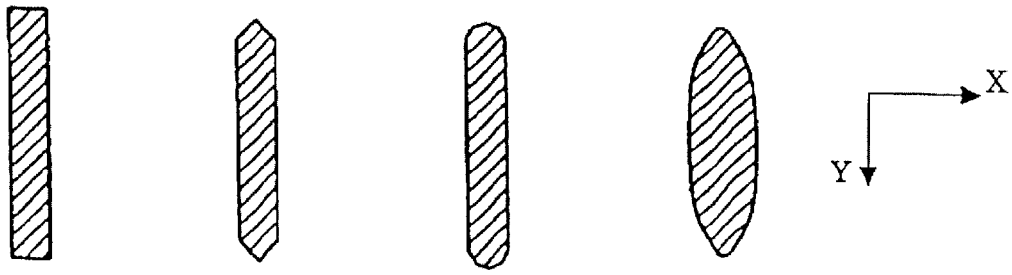
FIG. 9 is an illustration of modifications of an inductor via hole.
Figure 10:
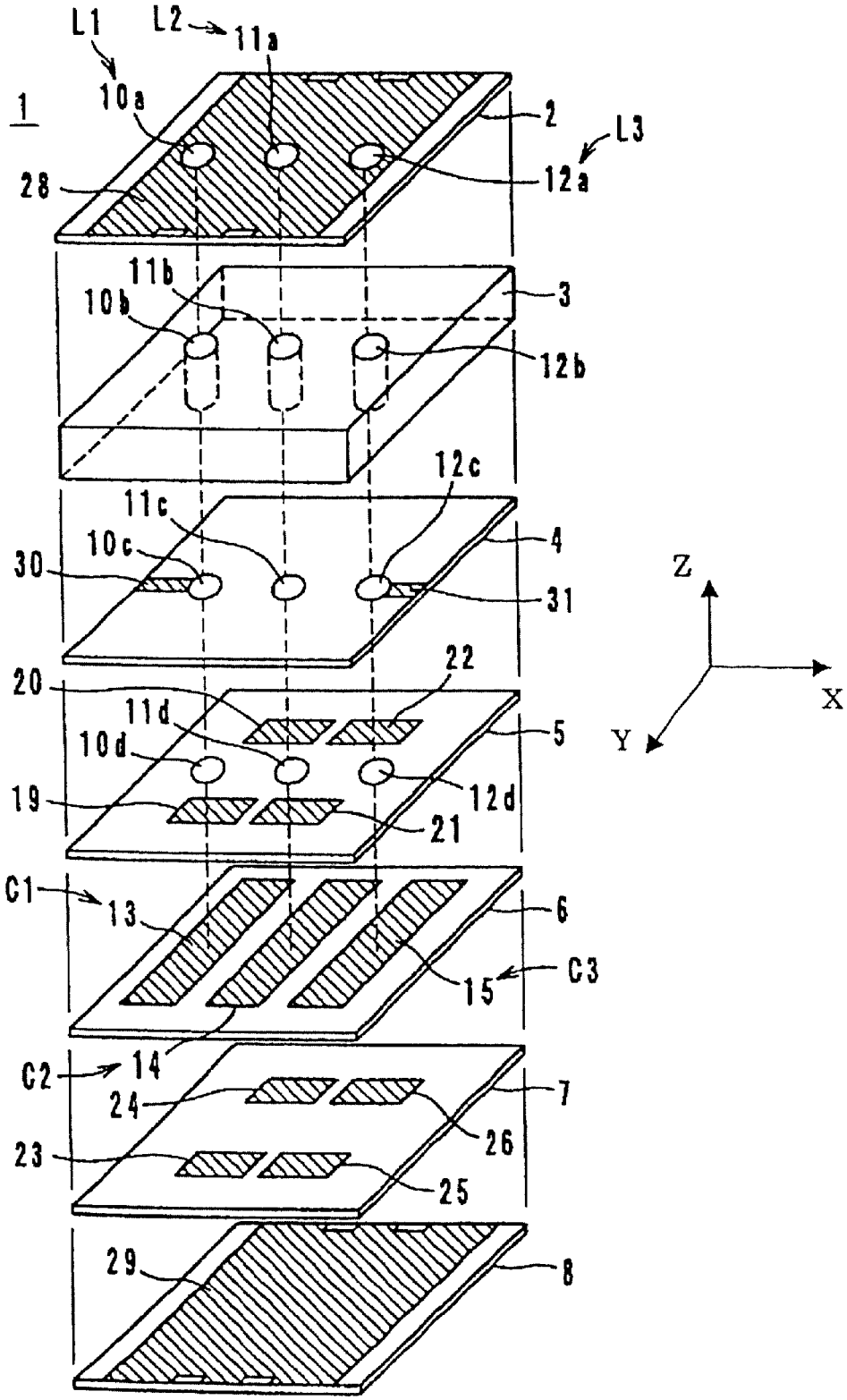
FIG.10 PRIOR ART
FIG. 10 is an exploded perspective view showing a conventional LC-included electronic component.
Figure 11:
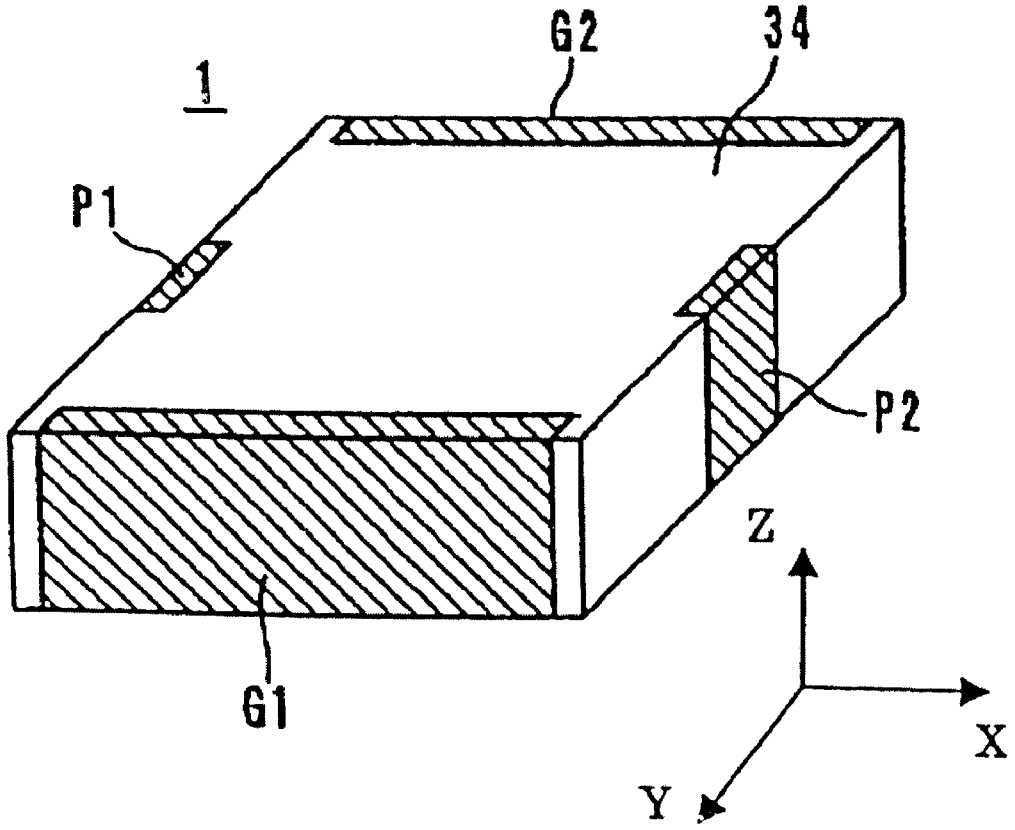
FIG.11 PRIOR ART
FIG. 11 is a perspective exterior view of the LC-included electronic component shown in FIG. 10.

Each section of the inductor via holes 83*a* to 85*d* is an arbitrary shape, and in addition to the shape shown in FIG. 7, a shape that has linear ends as shown in portion (A) of FIG. 9, a shape that has spiral ends as shown in portion (B) of FIG. 9, and a shape that has polygonal ends as shown in portion (C) of FIG. 9 may be used. In addition, a shape that has elliptic ends as shown in portion (D) of FIG. 9 may be used.

The LC-included electronic component according to the present invention is not limited to the foregoing preferred embodiments but may be variously modified with the spirit of the present invention.

LC components include bandpass filters, low-pass filters, and high-pass filters. The LC components may also include duplexers obtained by combining bandpass filters, and duplexers obtained by combining low-pass filters, high-pass filters, and trap circuits, or different types of circuits. In addition to the duplexers, the LC components include components of a type in which a plurality of filters are built into one laminated unit, such as triplexer and diplexer, and components of a type that have a built-in filter and circuit. A diplexer is obtained by combining, a low-pass filter and a high-pass filter. Moreover, a type in which a shield pattern is provided on either the top or bottom of a laminated unit may be used.

Although the foregoing preferred embodiments are such that insulating sheets each having conductor patterns and via holes are monolithically burned after being stacked, the present invention are not limited to the preferred embodiments. Pre-burned insulating sheets may be used. In addition, the LC components may be produced using the following process. After using paste insulating material to form an insulating layer by printing or other suitable method, paste conductive material is applied to the surface of the insulating layer to form a conductive pattern and a via hole. Next, by applying paste insulating material, an insulating layer is formed. Similarly, by performing successive application in order, an LC component having a layered structure is obtained.

While the present invention has been particularly shown and described with reference to preferred embodiments thereof, it will be understood by those skilled in the art that the foregoing and other changes in form and details can be made without departing from the spirit and scope of the invention.

What is claimed is:

1. An LC-included component comprising:

at least two LC resonators, each of said at least two LC resonators including at least one inductor and at least one capacitor, said at least one inductor and said at least one capacitor provided in a laminated unit defined by stacked insulating layers, wherein:

said at least one inductor of each of said at least two LC resonators is defined by via holes successively connected in a stacking direction in which the insulating layers are stacked;

said at least one inductor of said at least two LC resonators being arranged in an X direction of an X-Y plane;

a mutual inductance being produced between the at least one inductor of a first of said at least two LC resonators and the at least one inductor of a second of said at least two LC resonators, and said at least two LC resonators being magnetically coupled; and each of said via holes having a section shape on the X-Y plane that is substantially perpendicular to said stacking direction such that a dimension in the Y direction is greater than a dimension in the X direction.

2. An LC-included component according to claim 1, wherein the section shape on said X-Y plane of each of said via holes is configured such that each of two ends in the Y direction is wider than the width of the central portion of the shape.

3. An LC-included component according to claim 1, wherein input and output terminals which are connected to said via holes are provided at both ends of said laminated unit in the X direction.

4. An LC-included component according to claim 1, wherein said LC-included component is a laminated LC filter.

5. An LC-included component according to claim 1, wherein the Y direction of said via holes is about one to about four times greater than the dimension of said via holes in the X direction.

6. An LC-included component according to claim 1, wherein said at least one capacitor is defined by a capacitor pattern opposed to a shield pattern, with one of said insulating layers provided therebetween.

7. An LC-included component according to claim 1, wherein each of said via holes has a substantially ellipse shape.

8. An LC-included component according to claim 2, wherein said two ends of each of said via holes have a substantially octagonal shape.

9. An LC-included component according to claim 2, wherein each of said via holes includes substantially circular ends and linear central portions.

10. A method of manufacturing an LO-included component comprising:

providing at least two LC resonators, each of said at least two LC resonators including at least one inductor and at least one capacitor, said at least one inductor and said at least one capacitor provided in a laminated unit defined by stacked insulating layers;

forming via holes in said insulating layers to define said at least one inductor of each of said at least two LC resonators such that said via holes are successively connected in a stacking direction in which the insulating layers are stacked;

arranging said at least one inductor of said at least two LC resonators in an X direction of an X-Y plane;

arranging said at least two LC resonators to produce a mutual inductance between the at least one inductor of one of said at least two LC resonators and the at least one inductor of another one of said at least two LC resonators;

arranging said at least two LC resonators to be magnetically coupled; and configuring each of said via holes to have a section shape on the X-Y plane that is substantially perpendicular to said stacking direction such that a dimension in the Y direction is greater than a dimension in the X direction.

11. A method of manufacturing an LC-included component according to claim 10, wherein the section shape on said X-Y plane of each of said via holes is configured such that each of two ends in the Y direction is wider than the width of the central portion of the shape.

12. A method of manufacturing an LC-included component according to claim 10, further comprising providing input and output terminals at both ends of said laminated unit in the X direction and connecting said input and output terminals to said via holes.

13. A method of manufacturing an LC-included component according to claim 10, wherein said LC-included component is a laminated LC filter.

14. A method of manufacturing an LC-included component according to claim 10, wherein the Y direction of said via holes is about one to about four times greater than an the dimension of said via holes in the X direction.

15. A method of manufacturing an LC-included component according to claim 10, further comprising the step of forming said at least one capacitor by forming a capacitor pattern opposed to a shield pattern, with one of said insulating layers provided therebetween.

16. A method of manufacturing an LC-included component according to claim 10, wherein each of said via holes has a substantially ellipse shape.

17. A method of manufacturing an LC-included component according to claim 11, wherein said two ends of each of said via holes have a substantially octagonal shape.

18. A method of manufacturing an LC-included component according to claim 11, wherein each of said via holes includes substantially circular ends and linear central portions.

* * * * *